United States Patent [19]

Brückel et al.

[11] 4,219,272

[45] Aug. 26, 1980

[54] ELECTROPHOTOGRAPHIC COPIER WITH REPLACEABLE PHOTOCONDUCTIVE SHEET

[75] Inventors: Dieter Brückel; Günther Jahn, both of Kaufbeuren, Fed. Rep. of Germany

[73] Assignee: Olympia Werke Ag, Wilhelmshaven, Fed. Rep. of Germany

[21] Appl. No.: 32,002

[22] Filed: Apr. 20, 1979

[30] Foreign Application Priority Data

Apr. 20, 1978 [DE] Fed. Rep. of Germany ..... 2817300

[51] Int. Cl.[2] ..... G03G 15/00; B41F 1/28

[52] U.S. Cl. ..... 355/16; 101/415.1; 355/3 DR

[58] Field of Search ..... 355/16, 3 DR, 3 SH, 355/3 BE; 101/415.1, DIG. 13

[56] References Cited

U.S. PATENT DOCUMENTS

| | | | |
|---|---|---|---|
| 3,719,142 | 3/1973 | Abe et al. | 101/415.1 X |
| 3,750,573 | 8/1973 | Hauesler et al. | 101/415.1 |
| 3,839,961 | 10/1974 | Murata | 355/3 DR |
| 3,867,026 | 2/1975 | Ogawa | 355/16 X |
| 3,903,795 | 9/1975 | Suzuki | 355/3 DR |
| 4,056,829 | 11/1977 | Ikeda | 101/415.1 X |
| 4,161,358 | 7/1979 | Boschet | 101/415.1 X |

*Primary Examiner*—R. L. Moses
*Attorney, Agent, or Firm*—Spencer & Kaye

[57] ABSTRACT

An electrophotographic copier includes a replaceable photoconductive sheet having a leading edge portion and a trailing edge portion; a guide drum rotatably supported by a drum shaft and having a holding device for securing the leading sheet edge to the guide drum; a charging station, an illuminating station, a developing station, a transfer station and a conductive sheet cleaning station arranged in a circumferential distribution about the guide drum. The leading edge of the photoconductive sheet is attached to the guide drum and, upon rotation of the guide drum, a pressing roll, brought into engagement with the guide drum by a control mechanism, presses the trailing edge of the photoconductive sheet on the leading edge, as a result of which, by means of an interposed adhesive, the photoconductive sheet is bonded together to form an endless band about the guide drum. The control mechanism is actuated by one of the processing stations arranged about the guide drum, so that when such processing station is moved into an open position providing access to the photoconductive sheet, the pressing roller is automatically lowered onto the guide drum and, conversely, when the processing station is moved into its closed position, the pressing roller is automatically lifted off the guide drum.

14 Claims, 4 Drawing Figures

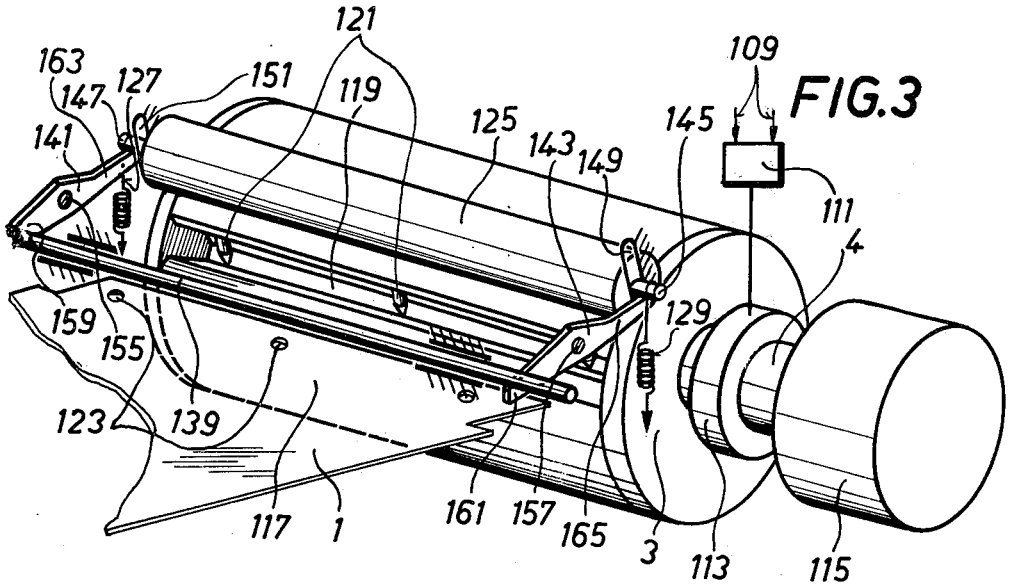
FIG.3
FIG.4
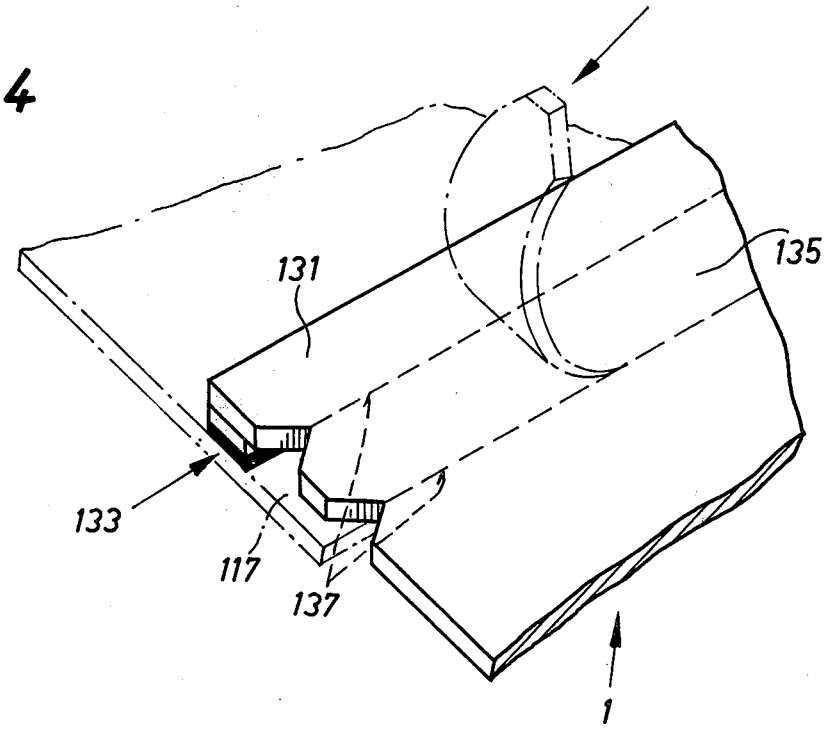

ELECTROPHOTOGRAPHIC COPIER WITH REPLACEABLE PHOTOCONDUCTIVE SHEET

BACKGROUND OF THE INVENTION

This invention relates to an electrophotographic copying apparatus (hereafter "photocopier") having a replaceable photoconductive sheet of finite length. The leading edge of the sheet is secured to a guide drum by means of a holding device. About the guide drum there are arranged, in close vicinity to one another, a charging station, an illuminating station, a developing station, a transfer station as well as a cleaning station where, respectively and in sequence, the photoconductive sheet is charged and photographically exposed to light, the image is developed by a magnetic toner, the image on the photoconductive sheet is transferred to a record-medium and the photoconductive sheet is cleaned.

A large proportion of known and widely used photocopiers have a recording drum which carries on its cylindrical surface a layer of recording material, for example, a photoconductive layer. The drum rotates in a housing which also accommodates the various processing stations. Since, because of a deficiency inherent in the principle of photocopying processes, a complete transfer of the toner—which is applied for rendering visible the latent charge image—to the record-medium (copy) is not feasible, the residual toner has to be removed from the drum by mechanical means, for example, with the aid of a brush. If such a toner-removing operation is not performed, a toner film builds up on the photoconductive layer, making necessary a frequent cleaning or premature replacement of the recording drum to ensure that the copy quality does not fall below a predetermined standard. It is another disadvantage of photoconductive layers provided firmly on the recording drum that a replacement of the entire drum is necessary as soon as the upper surface thereof is damaged.

A cleaning, an examination for damaged areas and a replacement of the recording drum can be performed only by qualified personnel; this circumstance increases the cost of an otherwise low-price copy obtained by an electrophotographic copying process.

The above-discussed disadvantages are eliminated in known copiers by providing a photoconductive sheet maintained taut about the drum. Such an arrangement is disclosed, for example, in U.S. Pat. No. 3,480,361. The photoconductive sheet extends from a supply roll positioned inside the copier drum to the outside thereof, extends about the drum circumference, then enters the drum and is wound on a take-up roll. This arrangement provides for an automatic replacement of the photoconductive layer at the end of its useful life. This mechanically complex system is expensive and is used only in high-output automatic copiers which otherwise would have to be continuously attended by maintenance personnel.

Further, U.S. Pat. No. 3,834,808 discloses an electrophotographic copier which has a replaceable photoconductive sheet positioned on a drum-shaped guide component and provided at both ends with holder plates. After positioning the sheet about the cylindrical outer face of the drum, bore holes provided in the holder plates at one end of the sheet are brought into alignment with holder pins carried by the drum, while a spring at the other end of the image plate is hooked into a spring-supporting post also carried by the drum. Although in this manner, to be sure, the photoconductive sheet can be mounted securely on the drum, its involved replacement requires a certain skill and adroitness on behalf of the operating personnel.

Further, German Auslegeschrift (Published Accepted Patent Application) No. 2,406,162 discloses an electrophotographic copier including a photoconductive sheet glued together at its ends to constitute an endless band. This known arrangement, however, discloses no copier in which the trailing end of the photoconductive sheet is automatically connected with the leading end thereof.

SUMMARY OF THE INVENTION

It is an object of the invention to provide an improved electrophotographic copier which has a replaceable photoconductive sheet of finite length carried by a guide drum, wherein a replacement of the sheet can be effected rapidly, securely and without particular skill.

This object and others to become apparent as the specification progresses, are accomplished by the invention, according to which, briefly stated, the leading edge of the photoconductive sheet is attached to the guide drum and, upon rotation of the guide drum, a pressing roll, brought into engagement with the guide drum by a control mechanism, presses the trailing edge of the photoconductive sheet on the leading edge, as a result of which, by means of an interposed adhesive, the photoconductive sheet is bonded together to form an endless band about the guide drum. The control mechanism is actuated by one of the processing stations arranged about the guide drum, so that when such processing station is moved into an open position providing access to the photoconductive sheet, the pressing roller is automatically lowered onto the guide drum and, conversely, when the processing station is moved into its closed position, the pressing roller is automatically lifted off the guide drum.

It is an advantage of the invention that it provides for a simple and rapid replacement of the photoconductive sheet without requiring particular adroitness by the maintenance personnel. The trailing edge of the photoconductive sheet has an adhesive layer which, by means of a controlled, lowerable pressure roll is pressed against the leading sheet edge. The control of the raising and lowering of the pressure roll is effected by a cleaning station which is movable from its working position into a released position in which it frees the guide drum for allowing a replacement of the photoconductive sheet.

BRIEF DESCRIPTION OF THE DRAWINGS

FIG. 3 is a schematic perspective view of a component of the preferred embodiment.

FIG. 4 is a fragmentary perspective view of a component of the structure shown in FIG. 3.

DESCRIPTION OF THE PREFERRED EMBODIMENT

Figure 1:
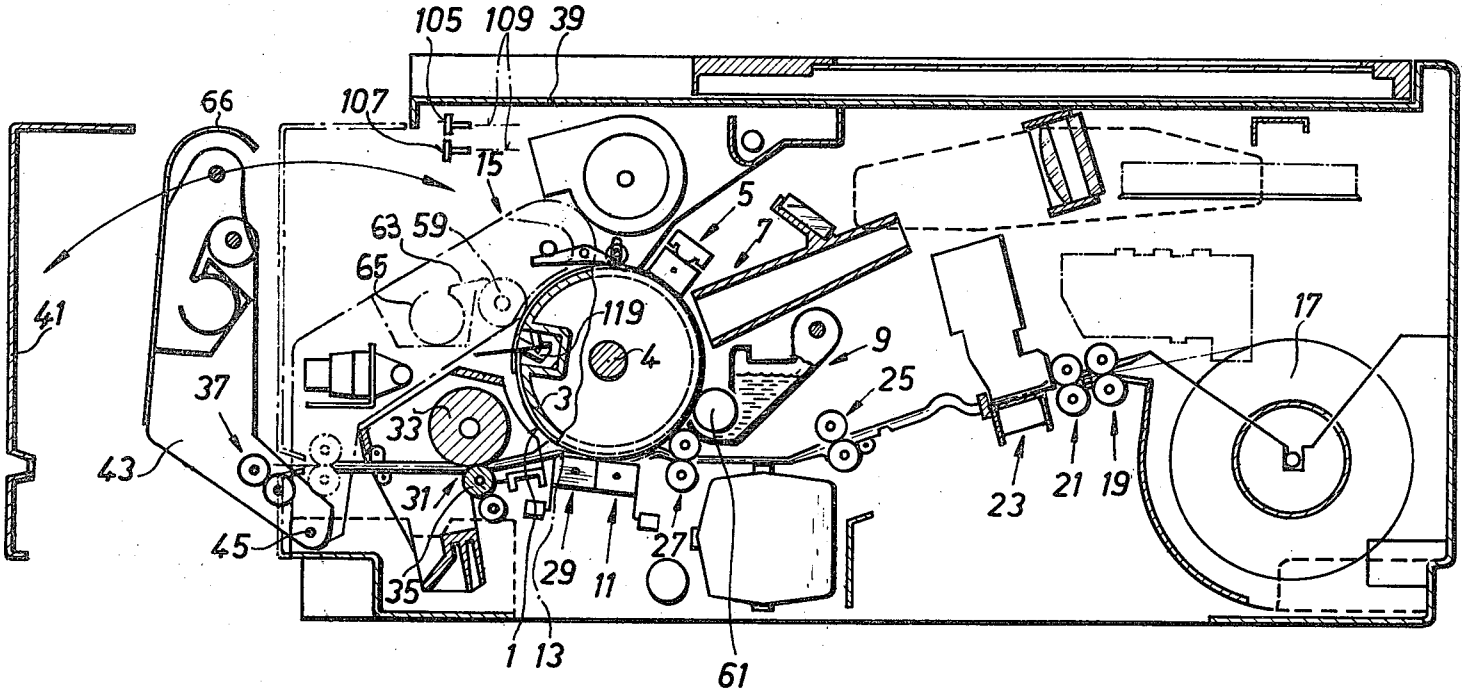
FIG. 1 is a schematic sectional side elevational view of an electrophotographic copier incorporating a preferred embodiment of the invention.

Turning now to FIG. 1, the electrophotographic copier shown therein comprises a photoconductive sheet 1 firmly secured to a guide drum 3 which is rotatably supported in the copier frame (not shown) and which, by virtue of its rotation, moves past the individual processing stations arranged about the circumference of the drum.

Thus, first, the photoconductive sheet 1 is charged in a charging station 5, then it is photographically exposed in station 7 and thereafter it is moved into the developing station 9 for development. Subsequently, the image on the photoconductive sheet 1 is transferred in a transfer station 11 to a record-medium 13. The toner particles which remain on the photoconductive sheet 1 subsequent to the transfer are removed from the sheet 1 in a cleaning station 15. The above-outlined processing stations are shown only schematically and may be of various designs.

The record-medium 13 is drawn from a supply roll 17 and advanced between feed roller pairs 19 and 21, to a cutting device 23 where sheets of predetermined length are cut. The severed sheets are thereafter brought into contact with the photoconductive sheet 1 on the guide drum 3 by means of additional feed roller pairs 25 and 27. The image developed on the photoconductive sheet 1 is transferred to the record-medium 13 by a transfer head of the transfer station 11 and thereafter the record-medium 13 is separated from the photoconductive sheet 1 by a separator head 29 and is advanced to a pressure-fixing station 31. The latter is formed of two pressure rolls 33 and 35 which are spring-biased against one another. Subsequent to the pressure fixing of the toner image onto the record-medium 13, the latter is discharged (deposited) by a feed roller pair 37.

Figure 2:
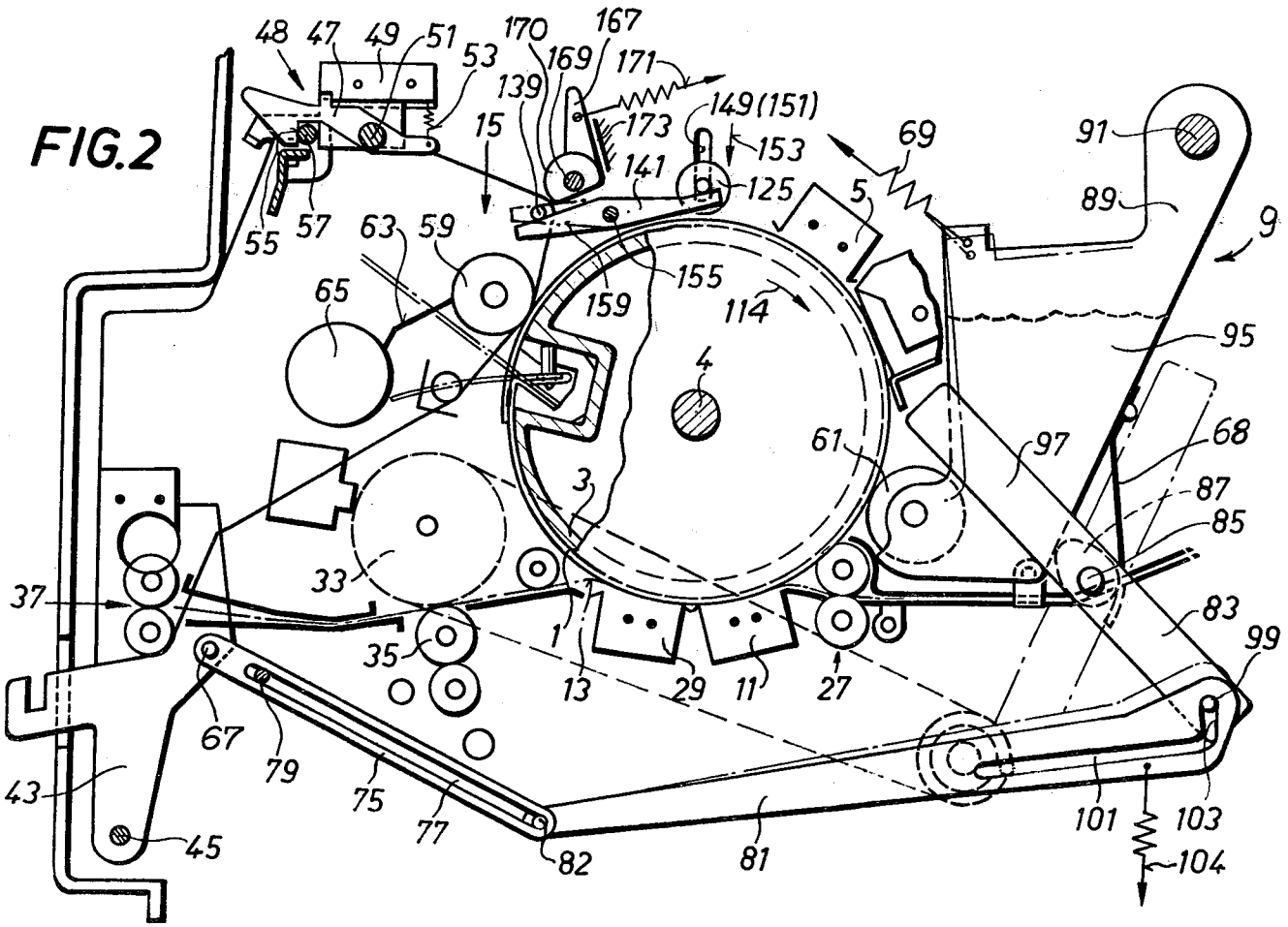
FIG. 2 is a schematic sectional side elevational view of a detail of FIG. 1 on a greater scale.

Also referring now to FIG. 2, after the production of, for example, 600 copies, the photoconductive sheet 1 is used up and thus has to be replaced. For this purpose, first a front cover 41—forming part of a copier housing 39—is removed. Thereafter, the cleaning station 15 which is supported in a first rocker 43 is, after unlatching a locking device 48, swung from its dash-dotted position into its solid-line position shown in FIG. 1. The lock 48 has at least one latch lever 47 which is rotatably supported on a shaft 51 held in a bearing bracket 49. The latch lever 47 which can be shifted and immobilized in the copier frame, is biased into a counterclockwise direction as viewed in FIG. 2, by a tension spring 53 and hooks with a locking face 55 behind a detent pin 57 mounted on the rocker 43. It is feasible to provide on both sides of the rocker 43 corresponding locking devices. The first rocker 43 is pivotally supported on a shaft 45 which extends parallel to the shaft 4 of the guide drum 3.

The cleaning station 15 has, for cleaning the photoconductive sheet 1 subsequent to a transfer of a toner image from the photoconductive sheet onto the record-medium 13, a magnetic brush 59 which is formed of the same magnetic single-component as a magnetic developing brush 61 of the developing station 9. Thus, the magnetic cleaning brush 59 removes the residual toner particles from the photoconductive sheet 1 subsequent to the transfer process. By means of a stripper 63 which cooperates with the magnetic cleaning brush 59, the toner particles are advanced into a container 65. The magnetic cleaning brush 59 is provided with a hood 66 for protecting it in the open position of the rocker 43 in which the latter permits access to the guide drum 3 for replacing the photoconductive sheet 1 as will be described below.

To the first rocker 43 there is articulated, at 67, a connecting lever 75 which has a guide slot 77 into which projects a support pin 79 attached to the copier frame. By virtue of this arrangement the connecting lever 75 is shiftably and rotatably supported. The connecting lever 75 is further articulated to a link 81 which, in turn, is connected with a pivotal lever 83. A shaft 85, fixedly attached to the pivotal lever 83, is rotatably supported in the copier frame and carries two eccentric members 87 (only one shown in FIG. 2). A second rocker 89 is pivotally mounted on a support shaft 91 and is swingable thereabout by the eccentric members 87. The second rocker 89 rotatably supports the magnetic developing brush 61 and includes a toner receptacle 95. As will be described later, the first rocker 43 and the second rocker 89 are connected to one another in such a manner by means of the linkage assembly 83, 81 and 75 that for replenishing the toner receptacle 95 with the toner, only the second rocker 89 is pivoted away from the guide drum 3, whereas for replacing the photoconductive sheet 1, both rockers 43 and 89 are pivoted away from the guide drum 3.

The pivotal lever 83 has a manually engageable handle 97, by means of which the rocker 89 can be pivoted from the solid-line position into the broken-line position as shown in FIG. 2 for refilling the toner receptacle 95. Such a motion of the second rocker 89 is effected by the camming interaction of the rotating eccentric member 87 with a leaf member 68 attached to the rocker 89. In the broken-line position of the second rocker 89, the magnetic developing brush 61 has moved away from the guide drum 3, whereby a lateral removal of the rocker 89 together with the toner receptacle 95 is possible without smudging the surface of the photoconductive sheet 1 by the magnetic developing brush 61. When, as described above, the second rocker 89 is swung by the pivotal lever 83, the first rocker 43 remains in its working position, because a guide pin 99 of the pivotal lever 83 slides along a guide slot 101 provided in the link 81 after the latter has been lifted. The guide slot 101 has at its end 102 an angled course 103 by means of which the pivotal lever 83 can be form-lockingly coupled with the link 81. Subsequent to returning the rocker 89 into its working position, a spring 104 pulls the link 81 downwardly, until the pin 99 arrives in an abutting relationship with the end of the slot portion 103.

If, on the other hand, the first rocker 43 is pivoted from its phantom-line position into its full-line position as shown in FIG. 1, the second rocker 89 too, is moved therewith from the solid-line position into the phantom-line position as shown in FIG. 2 because of the abutting relationship between the guide pin 99 and the outer end of the angled portion 103 of the guide slot 101. When the first rocker 43 is brought into its locked, closed position as shown in FIG. 2, the second rocker 89 is, by means of a return spring 69, moved back into its working position. It is noted that the pivotal lever 83 can be locked in its two end positions by non-illustrated arresting devices.

Also referring now to FIG. 3, with the removal of the cover 41 of the housing 39, access is gained to two switching members 105, 107 which are connected with a control member 111 by means of conductors 109. The control member 111 controls a clutch 113 for force-transmittingly coupling a drive 115 to the guide drum 3. By a manual actuation of the switching member 105, the guide drum 3 is rotated in the direction of the arrow 114 with the intermediary of the control member 111 and the clutch 113, while an actuation of the switching member 107 causes the guide drum 3 to turn in the other direction of rotation. Thus, with the aid of the switching members 105 and 107, the operator can rapidly bring a holding device, which is arranged at the circumference of the guide drum 3 and which serves for positioning the photoconductive sheet 1 on the guide drum 3, into a forward position in which it is rendered accessible by pivoting the first rocker 43 into its unlocked, open position. The holding device, as shown in FIGS. 2 and 3, comprises securing pins 121 which are arranged in a longitudinal groove 119 of the guide drum 3 and on which a leading edge 117 of the photoconductive sheet 1 can be hooked by means of holes 123. For engaging the leading edge 117 by the holding pins 121, the operator needs only to shift the leading edge 117 up to the abutment in the longitudinal groove 119 and release the free end of the photoconductive sheet 1. The threading of the holes 123 into the pins 121 then occurs automatically.

Thereafter, the guide drum 3 is rotated in the direction of the arrow 114 as shown in FIG. 2 by actuating the switching member 105.

When the rocker 43 was swung earlier into its open position, a pressing roll 125 has been automatically pressed—in a manner described below—against the circumference of the guide drum 3 by means of the springs 127, 129. Also referring now to FIG. 4, as the guide drum 3 rotates in the direction of the arrow 114, the photoconductive sheet 1, which is already secured at its leading edge 117 to the guide drum 3, is pressed against the circumference of the guide drum 3 by the roll 125, whereby the trailing edge 131 of the photoconductive sheet 1 is, with an adhesive layer 133, pressed against the leading edge 117 and thus automatically bonded thereto. The removal of the used photoconductive sheet 1 is effected with the aid of a tear strip 135 which extends along the entire width of the photoconductive sheet 1 and which is attached to the sheet 1 by weakened lines 137.

As the rocker 43 is pivoted away from its phantom-line, operative position into its solid-line, inoperative position (FIG. 1), two-arm pivotal levers 141, 143 supported on respective pins 155, 157, are released by a rod 139 which is fixedly supported on the rocker 43. The pivotal levers 141, 143 are in force-transmitting connection with respective axial support pins 145, 147 of the pressing roll 125. The support pins 145, 147 are slidably received in guide slots 149, 151 provided in the copier frame and are biased by springs 127, 129 in the direction of the arrow 153 (FIG. 2).

As the rocker 43 is pivoted back into its operative position, the rod 139 strikes the arms 159, 161 of the pivotal levers 141, 143, whereby the latter pivot in a counterclockwise direction (as viewed in FIG. 2) and, with their other arms 163, 165 engaging the axial pins 145, 147 of the pressure roll 125, lift the latter off the guide drum 3 against the force of the springs 127, 129.

In order to be able to lift the pressing roll 125 off the guide drum 3 even in the open position of the rocker 43, on the copier frame there are provided two manually engageable levers 167 (only one shown in FIG. 2) which are pivotal about a shaft 169 and have each an eccentric member 170. The eccentric members 170, when the levers 167 are manually urged counterclockwise against the force of the respective springs 171, exert a force on the arms 159, 161 of the levers 141, 143 to thus cause lifting of the pressing roll 125. In the position of rest, the hand-operated levers 167 are maintained against respective stops 173 by means of the respective springs 171.

In order to prevent a soiling of the pressing roll 125, the latter is provided, for example, by means of spraying, with a coating made of an anti-static material, such as Netic, product of Shield Division Perfection Mica Co., U.S.A.

According to the invention, the pressing roll may be made of a nonmagnetic material such as brass. In this manner the magnetic toner particles are prevented from being attracted by the photoconductive sheet 1 which would cause soiling of the pressing roll 125.

It is to be understood that the above description of the present invention is susceptible to various modifications, changes and adaptations and the same are intended to be comprehended within the meaning and range of equivalents of the appended claims.

What is claimed is:

1. In an electrophotographic copier including a replaceable photoconductive sheet having a leading edge portion and a trailing edge portion; a guide drum rotatably supported by a drum shaft and having a holding device for securing the leading sheet edge to the guide drum; a charging station, an illuminating station, a developing station, a transfer station and a conductive sheet cleaning station arranged in a circumferential distribution about the guide drum; the improvement comprising:

(a) opening means incorporated in at least one of said stations to provide for a mobility thereof between a closed, operative position and an open, inoperative position in which said drum is accessible for replacing said photoconductive sheet;

(b) a pressing roll displaceably supported adjacent said guide drum in a parallel orientation with said drum shaft; said pressing roll having a position in which it is out of contact with said guide drum and a position in which it is in pressing engagement with said guide drum;

(c) control means operatively connected to said opening means and to said pressing roll for moving said pressing roll into said pressing engagement with said guide drum when said one station is moved into said inoperative position and for moving said pressing roll out of contact with said guide drum when said one station is moved into said operative position; and (d) adhesive means carried by said photoconductive sheet for bonding said trailing and leading edge portions to one another by the pressure exerted by said pressing roll as said guide drum is rotated while said pressing roll is in its said pressing engagement with said guide drum subsequent to the attachment of said leading edge portion of said photoconductive sheet to said holding device of said guide drum.

2. An electrophotographic copier as defined in claim 1, wherein said opening means are incorporated in said cleaning station, and further wherein said opening means comprises a rocker accommodating components of said cleaning station and having open and closed positions corresponding to the open and closed positions of said cleaning station; a pivot shaft swingably supporting said rocker and extending parallel to said drum shaft; and a locking device for immobilizing said rocker in the closed position thereof.

3. An electrophotographic copier as defined in claim 2, wherein said control means comprises pivotally supported lever means cooperating with said pressing roll and with a part of said rocker; said part of said rocker exerting a lifting force on said pressing roll with the intermediary of said lever means when said rocker is moved into its closed position; said lifting force moving said pressing roll out of contact with said guide drum.

4. An electrophotographic copier as defined in claim 3, further comprising axial support pins attached to said pressing roll; means defining support slots receiving said support pins for displaceably positioning said pressing roll; spring means for urging said pressing roll towards said guide drum.

5. An electrophotographic copier as defined in claim 4, wherein said part of said rocker includes a transverse bar affixed to said rocker; and further wherein said lever means comprises two-arm levers situated at either end of said pressing roll; each two-arm lever having a first arm cooperating with a respective said support pin of said pressing roll and a second arm projecting in the path of motion of said transverse bar; in the closed position of said rocker said transverse bar maintains said first arms of said two-arm levers depressed, whereby said second arms of said two-arm levers maintain said pressing roll out of contact with said guide drum against the force of said spring means.

6. An electrophotographic copier as defined in claim 5, further comprising manually engageable lever means for moving said pressing roll out of engagement with said guide drum in the open position of said rocker.

7. An electrophotographic copier as defined in claim 1, wherein said pressing roll has a coating of anti-static material.

8. An electrophotographic copier as defined in claim 1, wherein said pressing roll is of non-magnetic material.

9. An electrophotographic copier as defined in claim 8, wherein said material is brass.

10. An electrophotographic copier as defined in claim 1, further comprising a drive for rotating said guide drum; and manually engageable switching means connected to said drive for rotating said guide drum through a desired angle.

11. An electrophotographic copier as defined in claim 10, further comprising a copier housing and a cover removably attachable to said housing for gaining access to said one station; said switching means being arranged in said copier behind said cover for being accessible from the outside solely in the removed state of said cover.

12. An electrophotographic copier as defined in claim 1, wherein said holding device comprises means defining a groove extending in said drum parallel to said drum shaft and a plurality of securing pins attached to said guide drum and extending in a spaced relationship in said groove; further comprising means defining a plurality of holes in said leading edge portion of said photoconductive sheet for being hooked on respective said securing pins.

13. An electrophotographic copier as defined in claim 1, wherein said adhesive means is an adhesive layer carried on said trailing edge portion of said photoconductive layer.

14. An electrophotographic copier as defined in claim 1, wherein said photoconductive sheet comprises a transverse strip portion attached to the remainder of the sheet by weakened lines, said transverse strip portion constituting a tearing strip for removing the photoconductive sheet from said guide drum.

* * * * *